US006230470B1

(12) United States Patent
Kimmerle et al.

(10) Patent No.: US 6,230,470 B1
(45) Date of Patent: May 15, 2001

(54) WALL FOR THE BOOTH OF A COATING PLANT

(75) Inventors: Walter Kimmerle, Holzgerlingen; Rainer Benzinger, Böblingen, both of (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 09/297,950

(22) PCT Filed: Jul. 20, 1998

(86) PCT No.: PCT/EP98/04524

§ 371 Date: May 10, 1999

§ 102(e) Date: May 10, 1999

(87) PCT Pub. No.: WO99/12657

PCT Pub. Date: Mar. 18, 1999

(30) Foreign Application Priority Data

Sep. 10, 1997 (DE) ..... 197 39 644

(51) Int. Cl.[7] ..... E04B 2/78; B05B 15/12

(52) U.S. Cl. ..... 52/762; 52/781; 52/582.2; 52/584.1; 52/220.7; 52/239

(58) Field of Search ..... 52/762, 781, 481.2, 52/582.1, 582.2, 584.1, 585.1, 220.7, 238.1, 239

(56) References Cited

U.S. PATENT DOCUMENTS 3,124,222 * 3/1964 Mote ..... 52/766 X
5,797,440 * 8/1998 Tsai ..... 52/584.1 X
5,881,518 * 3/1999 Edwards et al. ..... 52/239
6,076,322 * 6/2000 D'Andrea et al. ..... 52/481.2 X

FOREIGN PATENT DOCUMENTS

244040 * 12/1965 (AT) ..... 52/584.1
93 20 706 12/1994 (DE) .
0 647 476 4/1995 (EP) .

OTHER PUBLICATIONS

International Search Report dated Oct. 1998.

* cited by examiner

*Primary Examiner*—Laura A. Callo

(57) ABSTRACT

A wall for the booth of a coating plant is composed in a known manner of individual wall elements (1, 2). Each wall element (1, 2) comprises a load-bearing frame (3), which is formed from vertical posts (4, 5) made of sheet-metal sections and horizontal crosspieces (6, 7, 8, 9). The zones spanned by the posts (4, 5) and the crosspieces (6, 7, 8, 9) are covered by plates (10, 11, 12). At least the vertical posts (4, 5) have a section whose basic geometric shape is rectangular, although two of the sectional legs (15, 16), namely in each case the outer leg which is vertical to the associated plate (11) and the outer leg (16) which is parallel to the plate (11), do not extend over the entire length of the corresponding side of the rectangle. The interior of the posts (4, 5), in which fixtures and fittings can be installed, is thus accessible. At least one bent region (40) is shaped onto the shortened leg (16) which is parallel to the plate (11), which region extends back again towards the corresponding plate (11). This bent region (40) serves on the one hand to mechanically stiffen the corresponding post (4, 5) and on the other to secure a cover (18), which can be inserted between the shortened legs (16), which are parallel to the plates (11), of adjacent posts (4, 5) and thus closes off the access opening to the interiors of the two adjacent posts (4, 5) in a flush manner.

6 Claims, 2 Drawing Sheets

WALL FOR THE BOOTH OF A COATING PLANT

The invention relates to a wall for the booth of a coating plant, consisting of a plurality of wall elements, each of which comprises:

a) a frame consisting of at least two vertical posts and at least two horizontal crosspieces;

b) at least one plate, which covers a zone spanned by the posts and the crosspieces, wherein c) at least the posts consist of a bent metal sheet section, the cross-sectional shape of which is basically rectangular, wherein ca) a first leg, which is parallel to the plate and adjacent to the latter, of the section and a second leg, which extends perpendicularly to the first leg and points towards the centre of the wall element, of the section extend over the entire length of the corresponding side of the rectangle, and cb) a third leg, which is parallel to the plate yet distant from it, of the section and a fourth leg, which extends perpendicularly from the first leg, of the section only extend over a part of the length of the corresponding side of the rectangle, wherein furthermore d) adjacent wall elements each abut at the fourth legs of adjacent posts and are connected together here such that the free edges of the respective third legs of the adjacent posts bound a slit-shaped common access opening to the interiors of the two adjacent posts, which opening can be closed off by a common, removable cover.

Cables or other fixtures and fittings, which can be reached via the slit-shaped access openings, are usually installed in the hollow frames of wall elements of this kind. The access openings are normally closed by covers.

It was previously common practice to use extruded aluminium sections for the hollow frame parts (posts and/or crosspieces). As this material no longer met the fire prevention requirements, which had recently become more exacting, in certain applications, the extruded aluminium sections were also replaced by bent steel sheet sections in individual cases. A wall of this kind, corresponding to the type initially mentioned, is described in EP 0 647 476 A1. The cross-sectional shape of the post sections presented in the latter has shortened legs which lie entirely inside the basic rectangular contour, which is the geometric base for this section. The cover which closes off the access slit to the interior of the two adjacent posts is a flat sheet strip which is mounted by means of screws on the shortened legs of the two adjacent posts, which extend parallel to the corresponding plate. In order to achieve the required mechanical rigidity, the "open" angular section of the posts which is used here must be made of a relatively thick sheet. The covers are complicated to mount and to remove.

The object of the invention is to form a wall of the type initially mentioned such that the posts have a high mechanical strength, in particular flexural and torsional rigidity, while using little material, and that the cover can be secured easily and with a pleasing visual effect.

This object is achieved according to the invention in that e) a region which is bent in the direction of the plate and which serves to mechanically stiffen the post and secure the cover is shaped at the third leg of each post.

Thus according to the invention the cross-sectional shape of the post sections undergoes a modification which only appears slight at first sight: Because the shortened leg of the section which extends parallel to the plate does not end with its free edge inside the geometric rectangular contour, but is bent again in the direction of the plate, two different results are achieved: Firstly, this shaping produces the desired increased mechanical rigidity of the overall section, enabling the same mechanical stability to be attained as in the prior art while using thinner sheets or resulting in increased mechanical strength when using sheets of the same thickness. This "bent" region also serves the second purpose, which is to enable the cover which closes off the access opening to the interior of the two posts in a removable manner to be easily secured. For this cover can as a result be inserted between the two shortened legs of the adjacent posts such that its base is aligned with the regions of these shortened legs lying on the geometric rectangular contour. This makes the exterior of the entire wall attractive.

It is expedient if an additional bent region, extending parallel to the plate, is shaped onto the first region, which is bent in the direction of the plate, of the third leg of each post. Not only does this additional bent region increase the mechanical strength of the post; this measure also forms a "stop" for the cover which predetermines exactly how far the cover must be pushed to align it with the corresponding leg regions of the two adjacent posts.

If the cover is a shaped sheet-metal part having a base extending parallel to the plate in the mounting position and two lateral legs bent in the direction of the plates, it can be inserted particularly easily between the regions of the third legs of the two posts which are bent in the direction of the plate. In many cases the mechanical friction between the parts then abutting is sufficient to fix the cover at least temporarily.

A somewhat firmer connection between the cover and the two posts to which this is to be fixed is achieved if the cover can be elastically locked to one of the bent regions of the third legs of the adjacent posts. In this case the cover is therefore held in place not just by frictional forces, but also by elastic forces. The cover can nevertheless be both mounted and dismounted without any problems.

If it is more important to prevent the cover being removed unintentionally, the invention may also be formed such that the cover is provided with a rotary catch which can be operated from outside, engages behind a bent region of at least one post in a first position of rotation and is released from this bent region in a further position of rotation, so that the cover can be removed. The operating member for the rotary catch may consist of a simple shaft provided with a screwdriver slot or a polygonal recess. If, however, access to the interior of the two adjacent posts is to be reserved for certain individuals, the operating member may also be formed as a special tool or as a key.

Adjacent wall elements of the wall referred to in the above-mentioned EP 0 647 476 A1 were secured to one another by directly screwing together the shortened legs, extending perpendicularly to the plate, of adjacent, abutting posts. In order to reach these screw elements, which lie inside the cavity bounded by the two adjacent posts, access openings must be provided at the appropriate points in the legs, which are accessible from the outside, of the post sections. These access openings have to be closed off again at a later point by plugs. This type of assembly is relatively complicated; the plugs constitute additional necessary parts. A far more favourable formation in this case is that according to the invention in which adjacent posts of adjacent wall elements are each secured to one another by a plurality of pairs of screw parts which are each passed from outside through openings in the third legs of adjacent posts and lie from the outside by way of heads against these legs, wherein at least one of the two screw parts is passed through openings in the fourth legs of the two adjacent posts, and wherein one of the two screw parts is provided with an external thread and the other of the two screw parts with a complementary threaded hole. Unlike the screw connections in the prior art, these screw parts are easily accessible from outside. Because of the enlarged heads which these screw parts have, the openings in the exposed legs of the two posts are covered, so that no separate plugs are required to close openings in these legs.

An embodiment of the invention is illustrated in detail in the following on the basis of the drawings, in which FIG. 1 is a diagrammatic external view of two wall elements which have been placed together and constitute part of the wall of a booth of a coating plant;

Figure 1:
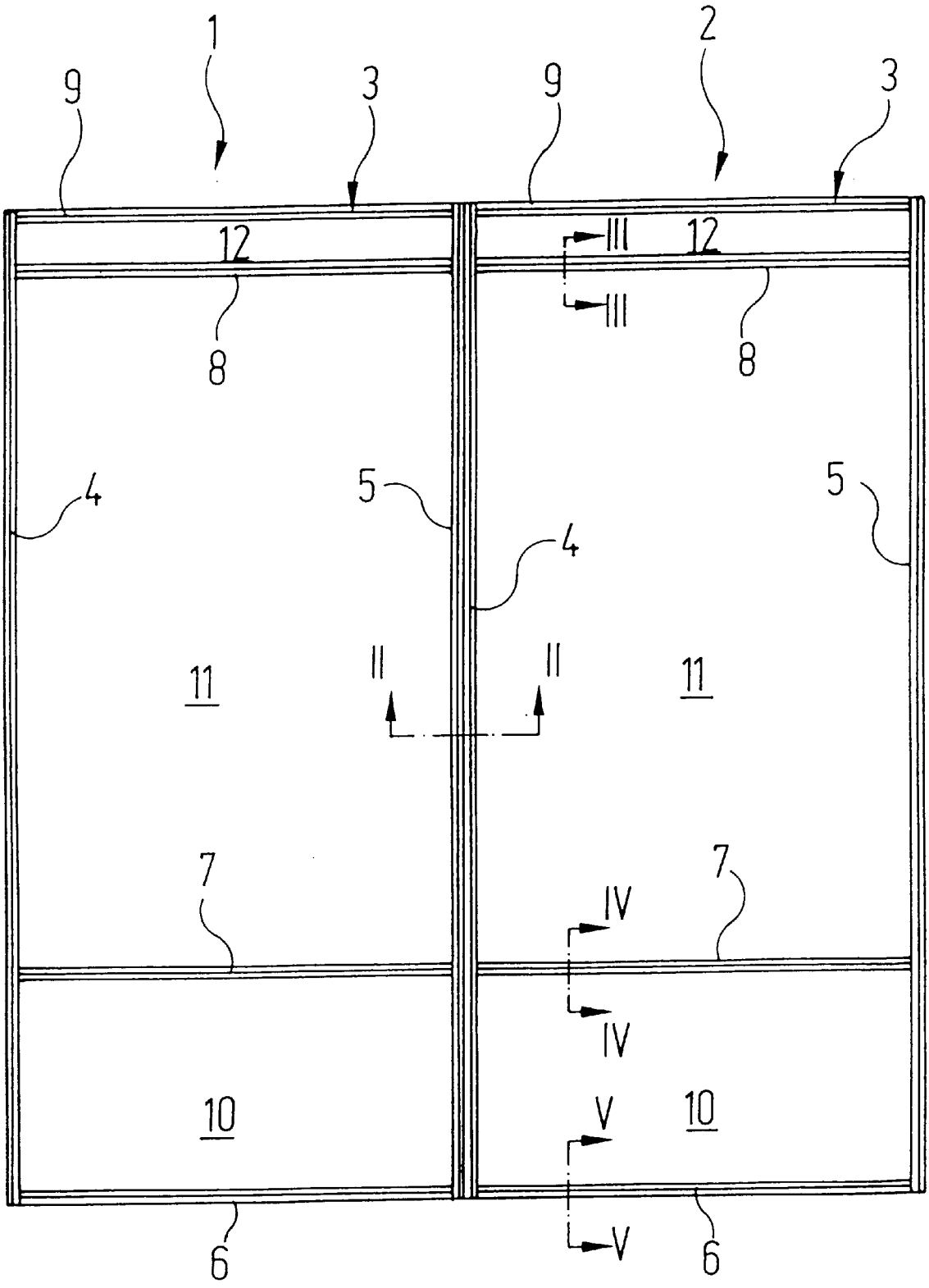
FIG. 1 shows two wall elements 1, 2 which form the wall of the booth of a coating plant, optionally with further identical wall elements adjoining next to these on the left and the right.

The same reference numbers are given to corresponding parts in the two wall elements 1, 2 in the following. Where it is necessary to make a distinction according to which of the two wall elements 1, 2 the part in question belongs, an "a" is added to the appropriate reference number to characterise the left-hand wall element and a "b" to characterise the right-hand wall element.

The wall elements 1, 2 comprise, in a manner known per se, a sectional frame 3, which is spanned by two lateral, vertical posts 4, 5 and, in the illustrated embodiment, four horizontal crossbars 6, 7, 8, 9. The zones bounded by the posts 4, 5 and the crosspieces 6, 7, 8, 9 are closed off by plates 10, 11, 12, from the back in FIG. 1, which are secured to the frame 3 in a manner not of interest here. As the plates 10, 11, 12 point towards the inside of the booth, where they are exposed to the coating which is used here and the solvents used for cleaning, they consist of a material which is chemically resistant to these substances. Plates consisting of glass or sheet metal which is corrosion-resistant at least at the surface, e.g. hot-dip aluminized steel sheet, are preferred. The outside of the wall elements 1, 2 can therefore be distinguished in FIG. 1.

At least the vertically extending posts 4, 5 of the frame 3 of the wall elements 1, 2 consist of bent steel sheet, the structural shape of which is explained in detail in the following in the light of FIG. 2.

Figure 2:
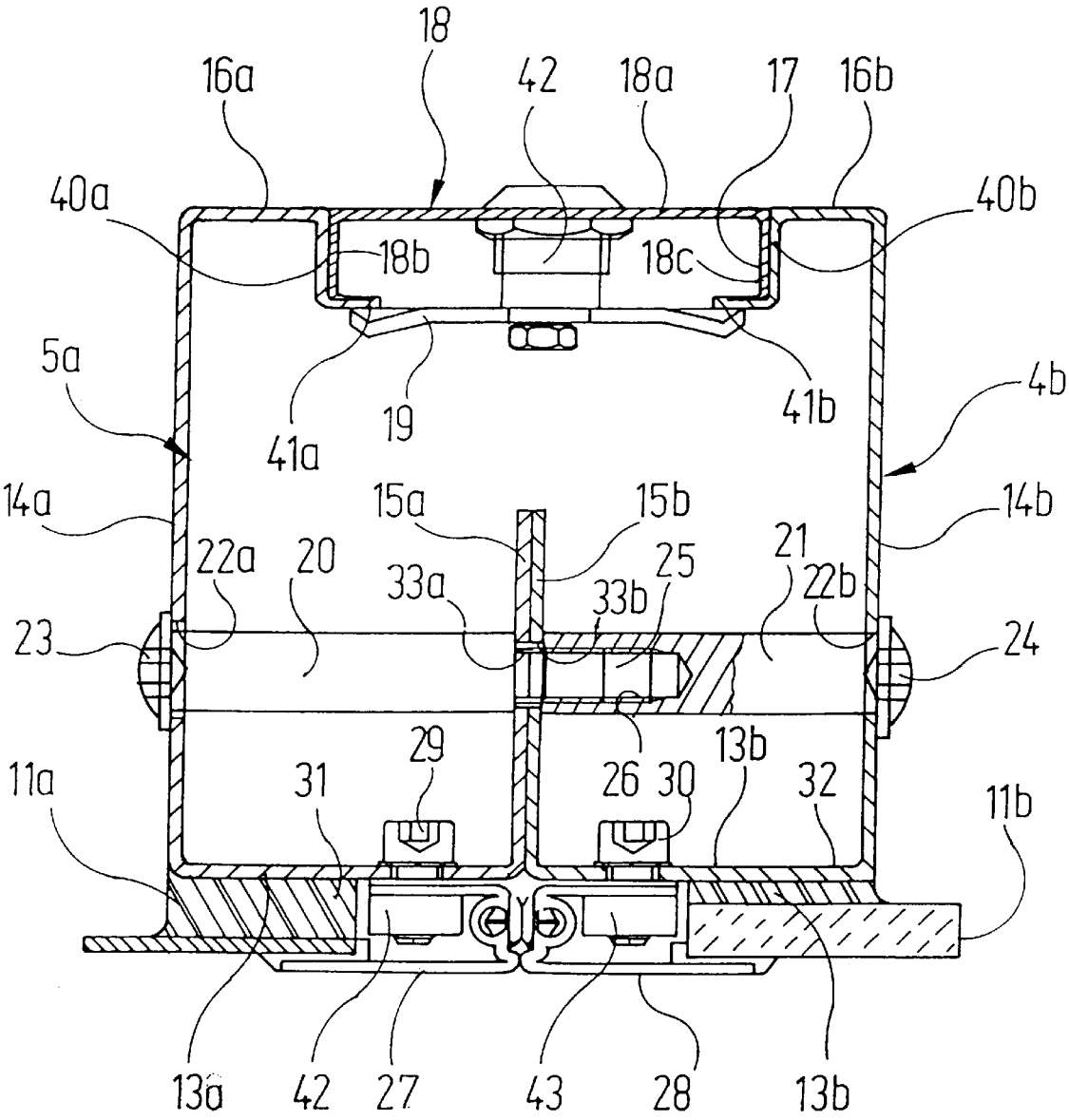
FIG. 2 is a scaled-up horizontal section through two adjacent posts of two wall elements according to the line II—II in FIG. 1.

FIG. 2 shows the right-hand post 5*a* of the left-hand wall element 1, which lies directly against the left-hand post 4*b* of the wall element 2 on the right in FIG. 1. The basic cross-sectional shape of both the post 5*a* and the post 4*b* is a rectangle which, however, is not completely closed. The sectional legs 13*a* and 13*b*, which are each adjacent to the corresponding plates 11*a* and 11*b*, extend completely along the corresponding side of the rectangle, in the same way as the legs 14*a* and 14*b*, which adjoin these legs perpendicularly and point towards the centre of the wall element 1 or 2. However the legs 15*a* and 15*b*, which adjoin the other side, remote from the centre of the wall element 1 or 2, of the legs 13*a*, 13*b* and are parallel to the legs 14*a* and 14*b*, only extend over a part of the corresponding complete side of the rectangle, as shown directly by FIG. 2.

The sectional legs 16*a* and 16*b*, which adjoin the sectional legs 14*a* and 14*b* at a right angle and are approximately parallel to the sectional legs 13*a*, 13*b*, likewise only extend over a part of the associated side of the rectangle. They are bent twice at a right angle and in opposite directions such that these legs 15*a* and 15*b* each have a first bent region 40*a*, 40*b*, which extends towards the corresponding plate 11*a*, 11*b*, and a second bent region 41*a*, 41*b*, which extends parallel to the respective plate 11*a*, 11*b*. The arrangement here is such that the interior of both posts 5*a* and 4*b* is accessible through the opening which is bounded by the free edges of the legs 16*a* and 16*b*, respectively, and 15*a* and 15*b*, respectively. Fixtures and fittings, in particular cables, can be accommodated in these interiors in a known manner.

The described construction of the two adjacent sectional legs 16*a* and 16*b* of the posts 5*a* and 4*b* produces a receiving space 17 for a cover 18 by means of which the interior of the two posts 5*a* and 4*b* can be simultaneously closed off. The cover 18 comprises a base 18*a*, which in the mounting position is aligned with the outer regions of the legs 16*a* and 16*b* of the posts 5*a* and 4*b*, and two lateral legs 18*b* and 18*c*, which are bent at a right angle from the base 18*a*, lie against the bent regions 40*a*, 40*b*, in each case extending parallel to these legs, of the corresponding legs 16*a* and 16*b* and also have the same dimensions in this direction. The cover 18 can therefore easily be inserted in the receiving space 17, which is formed by the described shaping of the sectional legs 16*a* and 16*b*, until it meets the stop.

The cover 18 may be secured inside the receiving space 17 by friction, although it is better to employ a simple interlock or clip-type mechanism. The illustrated embodiment comprises a number of rotary catches 19, which are arranged at a vertical spacing one above the other. The rotary catches 19 are shaped sheet-metal strips, the longitudinal extent of which is greater than the spacing between the free edges of the sectional legs 16*a* and 16*b* of the posts 5*a* and 4*b*. The rotary catches 19 can therefore be placed from behind as shown in FIG. 2 over the bent regions 41*a*, 41*b*, extending parallel to the plates 11*a*, 11*b*, of the sectional legs 16*a* and 16*b*. It is obviously impossible to withdraw the cover 18 outwards with the rotary catches 19 in this position. A rotary shaft, which is mounted in a housing 42 secured to the base 18*a* of the cover 18, is secured to each rotary catch 19. This rotary shaft can be rotated from outside together with the rotary catch 19 by a suitable tool. The rotary catch 19 can obviously be brought in this way into a position of rotation in which its outermost ends no longer engage behind the sectional legs 16*a* and 16*b* of the posts 5*a* and 4*b*; the cover 18 can then easily be removed outwards.

The described (additional) shaping of the sectional legs 16*a* and 16*b* pointing towards the outside of the wall elements 1, 2 therefore achieves two different results:

Firstly, the rigidity of the posts 4, 5 is increased, so that thinner sheets can be used to obtain the same mechanical strength, or increased mechanical stability is achieved with sheets of the same thickness. Secondly, this shaping affords the possibility of accurately and easily mounting the cover 18 by which the interior of the posts 5*a* and 4*b* is closed off and optionally locking this.

The two adjacent posts 5*a* and 4*b* and thus the two adjacent wall elements 1, 2 are held together as follows in the illustrated embodiment:

As can be seen from the lower half of FIG. 2, the sectional legs 15*a* and 15*b* of the two posts 5*a* and 4*b* lie directly against one another. They are pushed against one another by a plurality of pairs of screw parts 20, 21, which are provided at a vertical spacing from one another and are passed through corresponding openings 22 in the legs 14*a* and 14*b*, pointing towards the respective centre of the wall elements

1, 2, of the posts 5*a* and 4*b*. Both screw parts 20, 21 of a pair are in each case provided with a polygonal head 23 and 24, respectively, which covers the adjacent opening 22 in the sectional legs 14*a* and 14*b*. The screw part 20 on the left-hand side in FIG. 2 ends in a projecting screw bolt 25, while the screw part 21 on the right-hand side in FIG. 2 has a complementary threaded hole 26. The two posts 5*a* and 4*b* can thus be secured to one another by screwing together the two screw parts 20, 21 of the different pairs, without the interior of the posts 5*a* and 4*b* having to be accessible for this.

The method of securing the plates 11*a* and 11*b* to the posts 5*a* and 4*b* is illustrated at the very bottom of FIG. 2. For illustration purposes the left-hand plate 11*a* is drawn as a metal sheet, while the right-hand plate 11*b* is a glass pane. In both cases the securing operation is effected with the aid of frame sections 27, 28, which engage over the corresponding plates 11*a* and 11*b* with a corresponding leg and are secured by screws 29 and 30 and associated cage nuts 42, 43 to the adjacent legs 13*a* and 13*b* of the posts 5*a* and 4*b*. A corresponding strip-shaped shim 31 and 32, respectively, is provided between the respective plates 11*a* and 11*b* and the corresponding legs 13*a* and 13*b*. However details regarding the way in which the plates 11*a* and 11*b* are secured are of no interest in this connection.

What is claimed is:

1. Wall for the booth of a coating plant, consisting of a plurality of wall elements, each of which comprises:

a) a frame consisting of at least, two vertical posts and at least two horizontal crosspieces, b) at least one plate, which covers a zone spanned by the posts and the crosspieces, wherein c) at least the posts consist of a bent metal sheet section, the cross-sectional shape of which is basically rectangular, wherein ca) a first leg, which is parallel to the plate and adjacent to the latter, of the section and a second leg, which extends perpendicularly to the first leg and points towards the centre of the wall element, of the section extend over the entire length of the corresponding side of the rectangle, and cb) a third leg having a free edge, which is parallel to the plate yet distant from it, of the section and a fourth leg, which extends perpendicularly from the first leg, of the section only extend over a part of the length of the corresponding side of the rectangle, wherein furthermore d) adjacent wall elements each abut at the fourth legs of adjacent posts and are connected together here such that the free edges of the respective third legs of the adjacent posts bound a slit-shaped common access opening to the interiors of the two adjacent posts, which opening is closed off by a common, removable cover, characterised in that e) a region (40) which is bent in the direction of the plate (11) and which serves to mechanically stiffen the post (4, 5) and secure the cover (18) is shaped onto the third leg (16) of each post (4, 5).

2. Wall according to claim 1, characterised in that a second bent region (41), extending parallel to the plate (11), is shaped onto the region, which is bent in the direction of the plate (11), of the third leg (16) of each post (4, 5).

3. Wall according to claim 1, characterised in that the cover (18) is a shaped sheet-metal part having a base (18*a*) extending parallel to the plate (11) in the mounting position and two lateral legs (18*b*, 18*c*) bent in the direction of the plate (11).

4. Wall according to claim 1, characterised in that the cover can be elastically locked to one of the bent regions of the third leg of adjacent posts.

5. Wall according to claim 1, characterised in that the cover (18) is provided with a rotary catch (19) which can be operated from outside, engages behind a bent region (4*a*) of at least one post (5*a*, 4*b*) in a first position of rotation and is released from this bent region (41) in a second position of rotation, so that the cover (18) can be removed.

6. Wall according to claim 1, characterised in that the adjacent posts (4, 5) of adjacent wall elements (1, 2) are each secured to one another by a plurality of pairs of screw parts (20, 21) which are each passed from outside through openings (22) in the second legs (14) of adjacent posts (4, 5) and lie from outside by way of heads (23, 24) against these legs (14), wherein at least one (20) of the two screw parts is passed through openings (33) in the fourth legs (15) of the two adjacent posts (4, 5), and wherein one (20) of the two screw parts is provided with an external thread and the other (21) of the two screw parts with a complementary threaded hole (26).

* * * * *